US009142327B2

(12) United States Patent
Valentin et al.

(10) Patent No.: US 9,142,327 B2
(45) Date of Patent: Sep. 22, 2015

(54) CANISTER FOR TRANSPORTING AND/OR STORING RADIOACTIVE MATERIALS COMPRISING RADIALLY STACKED RADIOLOGICAL PROTECTION COMPONENTS

(75) Inventors: Christophe Valentin, Ecaquelon (FR); Olivier Bardon, Saint-Cloud (FR); Stavros Kitsos, St Remy les Chevreuse (FR)

(73) Assignee: TN INTERNATIONAL, Montigny le Bretonneaux (FR)

( * ) Notice: Subject to any disclaimer, the term of this patent is extended or adjusted under 35 U.S.C. 154(b) by 198 days.

(21) Appl. No.: 12/940,647

(22) Filed: Nov. 5, 2010

(65) Prior Publication Data

US 2012/0007004 A1 Jan. 12, 2012

(30) Foreign Application Priority Data

Nov. 10, 2009 (FR) ..... 09 57930

(51) Int. Cl.

| | |
|---|---|
| ***G21F 5/00*** | (2006.01) |
| ***G21F 5/10*** | (2006.01) |
| ***G21F 3/00*** | (2006.01) |
| *G21F 5/008* | (2006.01) |

(52) U.S. Cl.
CPC .. *G21F 5/10* (2013.01); *G21F 3/00* (2013.01); *G21F 5/008* (2013.01); *Y10T 29/49826* (2015.01)

(58) Field of Classification Search
USPC ..... 250/505.1, 506.1, 507.1, 515.1, 518.1; 376/272
See application file for complete search history.

(56) References Cited

U.S. PATENT DOCUMENTS

| | | | | |
|---|---|---|---|---|
| 4,330,711 | A * | 5/1982 | Ahner et al. | 250/506.1 |
| 4,453,081 | A * | 6/1984 | Christ et al. | 250/506.1 |
| 4,783,309 | A * | 11/1988 | Popp et al. | 376/272 |
| 4,847,505 | A * | 7/1989 | Suthanthiran | 250/507.1 |
| 5,641,970 | A * | 6/1997 | Taniuchi et al. | 250/506.1 |
| 5,887,042 | A * | 3/1999 | Akamatsu et al. | 376/272 |
| 7,485,884 | B2 * | 2/2009 | Funakoshi et al. | 250/506.1 |
| 2003/0010938 | A1 * | 1/2003 | Michels et al. | 250/507.1 |
| 2005/0077487 | A1 * | 4/2005 | Georii | 250/506.1 |
| 2005/0286674 | A1 * | 12/2005 | Fischer et al. | 376/272 |
| 2006/0006351 | A1 * | 1/2006 | Timpert | 250/506.1 |

(Continued)

FOREIGN PATENT DOCUMENTS

| | | |
|---|---|---|
| JP | 4-36697 | 2/1992 |
| JP | 2007-139677 | 6/2007 |

OTHER PUBLICATIONS

Preliminary Search Report for French Application No. 09/57930 dated Jun. 2, 2010.

*Primary Examiner* — Nicole Ippolito
*Assistant Examiner* — Jason McCormack
(74) *Attorney, Agent, or Firm* — Nixon Peabody LLP

(57) ABSTRACT

A canister for transporting/storing radioactive materials, comprising two concentric shells between which is housed a radiological protection device forming a barrier against gamma radiation, comprising a first and a second metal radiological protection components superimposed along a radial direction of the canister, the first component being supported against the outer shell and the second component being supported against the inner shell. In addition, the components are in contact with each other along an interface taking, in section along any plane integrating the longitudinal axis, the form of a straight line segment inclined in relation to this axis.

9 Claims, 3 Drawing Sheets

(56) References Cited

U.S. PATENT DOCUMENTS

| | | | | |
|---|---|---|---|---|
| 2006/0043320 | A1* | 3/2006 | Nicholson et al. | 250/506.1 |
| 2006/0120500 | A1* | 6/2006 | Georgii | 376/272 |
| 2006/0219960 | A1* | 10/2006 | Shimojo et al. | 250/518.1 |
| 2008/0069291 | A1* | 3/2008 | Singh et al. | 376/272 |
| 2008/0084958 | A1* | 4/2008 | Singh et al. | 376/272 |
| 2008/0209972 | A1* | 9/2008 | Funakoshi et al. | 72/273 |
| 2008/0265182 | A1* | 10/2008 | Singh et al. | 250/506.1 |
| 2009/0114856 | A1* | 5/2009 | Shimojo et al. | 250/506.1 |
| 2010/0230619 | A1* | 9/2010 | Tamaki | 250/506.1 |

* cited by examiner

CANISTER FOR TRANSPORTING AND/OR STORING RADIOACTIVE MATERIALS COMPRISING RADIALLY STACKED RADIOLOGICAL PROTECTION COMPONENTS

CROSS REFERENCE TO RELATED APPLICATIONS OR PRIORITY CLAIM

This application claims priority of French Patent Application No. 09 57930, filed Nov. 10, 2009.

TECHNICAL FIELD

The present invention relates to the field of transporting and/or storing radioactive materials, such as nuclear fuel assemblies, fresh or irradiated.

In particular, the invention relates to a canister comprising a radiological protection device laid out between two concentric shells, forming a barrier against gamma radiation.

STATE OF THE PRIOR ART

Conventionally, to ensure the transport and/or the storage of nuclear fuel assemblies, storage devices, also known as storage "baskets" or "racks", are used. These storage devices, normally of cylindrical shape and of substantially circular section, have a plurality of adjacent housings each of which is able to receive a nuclear fuel assembly. The storage device is intended to be housed in the cavity of a canister so as to form jointly with it a container for transporting and/or storing nuclear fuel assemblies, in which the nuclear material is confined.

The aforementioned cavity is generally defined by a lateral body extending along a longitudinal direction of the canister, said lateral body comprising for example two concentric metal shells jointly forming an annular space inside which is housed a radiological protection device, in particular to form a barrier against the gamma radiation emitted by the fuel assemblies housed in the cavity.

Conventionally, the radiological protection device is formed by means of several prefabricated components made of lead or one of its alloys, spread around the cavity, in the appropriate annular space defined by the two metal shells.

To do this, each of these components is inserted between the two shells, along a longitudinal insertion direction. Thus, an assembly clearance must be provided to allow such an insertion, said clearance having as consequence a discontinuity of material in the lateral body of the canister, along the radial direction in which are laid out successively the inner shell, the radiological protection components, and the outer shell. The observed discontinuity of material has the effect of a considerable decrease in the thermal conductivity of the lateral body of the canister, implying a low capacity of the latter to dissipate the heat produced by the fuel assemblies.

To minimise the negative impact of the discontinuities of material, the clearances between the radiological protection components and the shells may be reduced by lessening the manufacturing tolerances, but this proves nevertheless to be very costly, and does not in the least enable the discontinuities of material to be eliminated.

Other means may be employed to reduce the loss of thermal efficiency, such as that aiming to inject helium into the empty spaces. However, this technique induces a cost and poses serious problems of operating the canister.

Another solution consists in separating the radiological protection function from that of heat conduction, this then being fulfilled by means of additional fin type components linking the two shells, laid out alternately with the radiological protection components in the annular space. Nevertheless, this further complicates the design of the canister, and moreover necessitates the use of particular techniques to ensure that the fins are indeed in contact with each of the two shells of the lateral body.

SUMMARY OF THE INVENTION

The aim of the invention is thus to remedy, at least partially, the aforementioned drawbacks relative to embodiments of the prior art.

To do this, the object of the invention is a canister for transporting and/or storing radioactive materials, said canister comprising a lateral body extending around a longitudinal axis of said canister, said lateral body forming a cavity for housing the radioactive materials and comprising an inner metal shell and an outer metal shell, the two shells being concentric and forming jointly an annular space inside which is housed a radiological protection device forming a barrier against gamma radiation.

According to the invention, said radiological protection device comprises at least one first and one second metal radiological protection components superimposed along a radial direction of the canister, said first component being supported against the outer shell and said second component being supported against the inner shell. In addition, said first and second components are in contact with each other along an interface taking, in section along any plane passing through said interface and integrating the longitudinal axis, the form of a straight line segment inclined in relation to this axis.

The invention thus offers a shrewd design enabling the radiological protection components to conduct heat in a satisfactory manner between the two shells. Indeed, the heat is conveyed in a continuous manner firstly between the inner shell and the second radiological protection component thanks to the contact between these parts, then between the faces in contact of the first and second components, and finally between the first component and the outer shell, again on account of the contact provided between these parts.

Thus, the particular geometry and the arrangement of the radiological protection components make it possible to confer to the lateral body of the canister a satisfactory thermal conductivity. The presence of helium or heat conduction fins is thus no longer necessary, which makes it possible to have a canister of simplified design and manufacture.

Furthermore, since the first and second radiological protection components are no longer intended, as in the prior art, to come as close as possible to each of the two shells, but are each only in contact with one and at a distance from the other of the two shells, the manufacturing tolerances of said components may be increased. Advantageously a considerable cost reduction ensues.

Finally, it is noted that the contact force occurring at the interface of the first and second components superimposed radially is inclined in relation to the longitudinal direction. The intensity of this contact as well as the intensity of contact between the radiological protection components and their associated shell is thus dependent on the relative longitudinal position between the components. Consequently, during the insertion of one of the two protection components by longitudinal sliding between its associated shell and the other protection component, the contacts, once established, have an intensity that increases as the insertion continues, which confers to the components a self-tightening character between the shells. The increase in the intensity of these contacts is advantageous in the sense that is ensures better heat conduction. In this respect, it is noted that one and/or the other of the radiological protection components may be coated with a heat conducting layer at the contact interface, in order to yet further improve the heat conduction between these components. This layer is preferably of low thickness, and deformable, for example made of lead or one of its alloys. Naturally, this solution of heat conducting layer may also be adopted at the contacts between the radiological protection components and the shells.

Preferably, said inclined straight line segment forms with said longitudinal axis an angle (A) between 1 and 10°.

The interface thus inclined enables a satisfactory radial pinning of the radiological protection components against their associated shell, when these are constrained longitudinally.

Preferably, said interface between said first and second components is flat or truncated. Whatever the case, its surface nature confers a satisfactory overall thermal conductivity to the lateral body of the canister.

In the case where it is flat, it takes preferably, in any section along a plane orthogonal to the longitudinal axis, the form of a straight line segment orthogonal to a radial straight line passing through its centre. In the other case where it is truncated, it is preferentially coaxial with the inner and outer shells. Preferably, the outer surface of the first component supported against the outer shell is of straight section, or even more preferentially arc of circle shape of diameter identical to that of the inner surface of the outer shell against which it is supported, and the inner surface of the second component supported against the inner shell is of straight section, or even more preferentially arc of circle shape of diameter identical to that of the outer surface of the inner shell against which it is supported. Arc of circle sections are preferred, especially when they are centred on the longitudinal axis, because they thus enable surface contacts to be obtained between the shells and the radiological protection components.

Preferably, each of the first and second components is maintained only by contacts in the annular space. This implies, in particular, that no additional means of fixation are added either between a protection component and its associated shell, or between the two protection components superimposed radially. The design thus enables said components to mutually maintain each other by contact, by means also of the shells.

Moreover, said first and second components have an identical or different circumferential span.

By way of example, the canister comprises a plurality of first metal radiological protection components and a plurality of second metal radiological protection components, each first component being radially supported uniquely on one of said plurality of second components, and inversely, each pair of a first and a second components here having preferentially an identical circumferential span.

Finally, another object of the invention is a method for producing a canister as described above, in which firstly one of said first and second components is put in place in the annular space, then the other of said first and second components is inserted longitudinally between its associated shell and the component already put in place.

Other advantages and characteristics of the invention will become clear in the detailed non-limitative description given hereafter.

BRIEF DESCRIPTION OF DRAWINGS

This description will be made with reference to the appended drawings, among which.

DETAILED DESCRIPTION OF PREFERRED EMBODIMENTS

Figure 1:
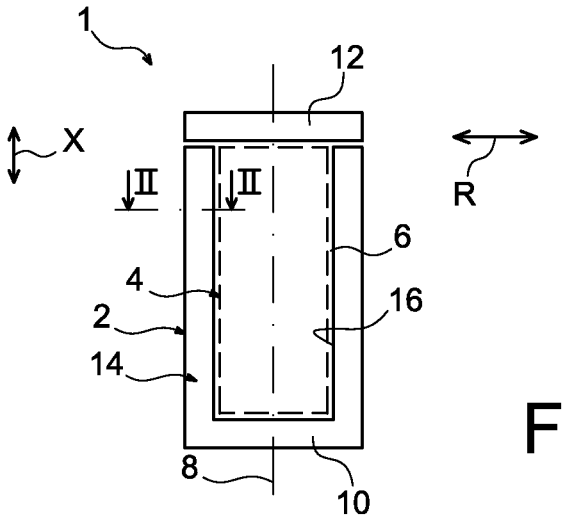
FIG. 1 represents a schematic view of a container for transporting and/or storing nuclear fuel assemblies, comprising a canister according to a first preferred embodiment of the present invention, only represented roughly.

Firstly with reference to FIG. 1, a container 1 for transporting and/or storing nuclear fuel assemblies is shown. It is in this respect recalled that the invention is in no way limited to the transport/storage of this type of nuclear material.

The container 1 comprises overall a canister 2, object of the present invention, inside of which is a storage device 4, also known as storage basket. The device 4 is provided to be placed in a cavity for housing 6 the canister 2, as shown schematically in FIG. 1, in which it is also possible to perceive the longitudinal axis 8 of said canister, merged with the longitudinal axes of the storage device and the housing cavity.

Throughout the description, the term "longitudinal" must be understood as parallel to the longitudinal axis 8 and to the longitudinal direction X of the canister, and the term "circumferential" must be understood as orthogonal to this same longitudinal axis 8, as well as to a transversal/radial R direction of the canister.

In a conventional manner and by way of reminder, it is noted that the storage device 4 comprises a plurality of adjacent housings arranged parallel to the axis 8, the latter each being able to receive at least one fuel assembly of square or rectangular section, and preferably only one. The container 1 and this device 4 have been shown in a vertical position of loading/unloading the fuel assemblies, different to the horizontal/lying down position normally adopted during the transport of the assemblies.

Generally speaking, the canister 2 has essentially a bottom 10 on which the device 4 is intended to lie in vertical position, a lid 12, and a lateral body 14 extending around and along the longitudinal axis 8, said body 14 defining a canister opening intended to allow the basket to penetrate into the housing cavity 6, and to be then sealed by the lid 12.

It is thus this lateral body 14 that defines the housing cavity 6, by means of a lateral inner surface 16 of substantially cylindrical shape and of circular section, and of axis merged with the axis 8.

The bottom 10, which defines the bottom of the cavity 6 open at the lid 12, may be formed from a single part with part at least of the lateral body 14, without going beyond the scope of the invention.

Figure 2:
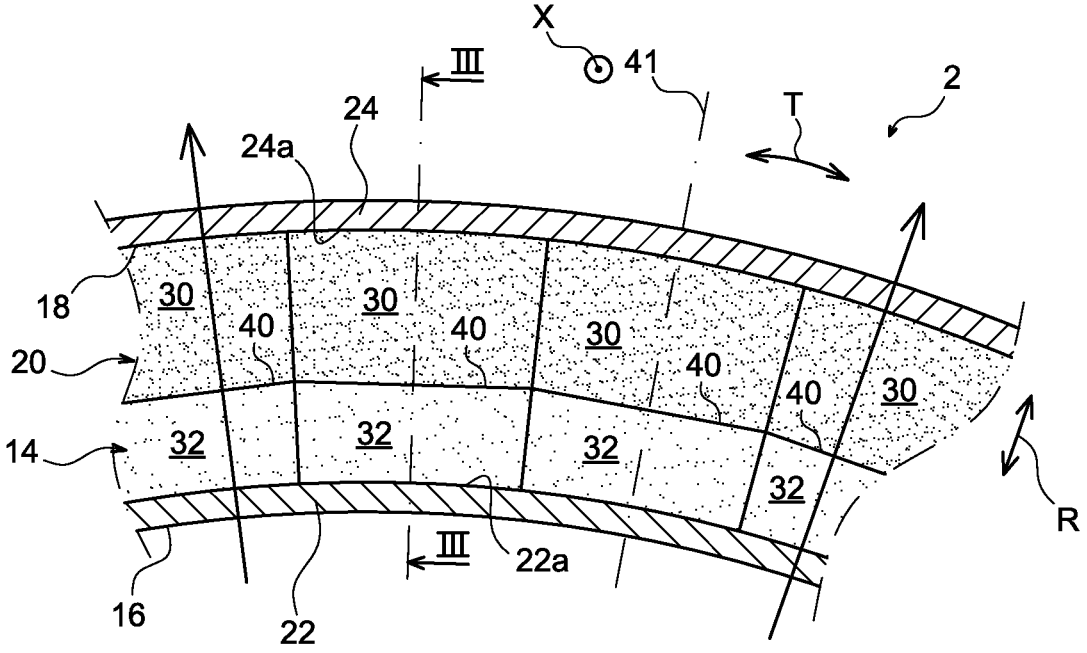
FIG. 2 represents a more detailed cross sectional view of a part of the canister, taken along the line II-II of FIG. 1.

With reference now to FIG. 2, it is possible to perceive in a detailed manner part of the lateral body 14, which has firstly two concentric metal shells forming jointly an annular space 18 centred on the longitudinal axis of the canister (not visible in this figure), this space 18 housing a radiological protection device 20 specific to the present invention. The shells 22, 24 are for example made of steel.

This protection device 20 is in particular designed to form a barrier against the gamma radiation emitted by the irradiated fuel assemblies housed in the cavity 6. Thus, it is housed between the internal shell 22, the inner surface of which corresponds to the inner lateral surface 16 of the cavity 6, and the outer shell 24.

As may be seen in FIG. 2, in this first preferred embodiment of the present invention, the protection device 20 comprises a plurality of first and second radiological protection components, respectively referenced 30 and 32. Here, the components are grouped together into pairs each comprising a first component 30 and a second component 32 superimposed radially, the pairs being adjacent and in contact along the circumferential direction T, also known as tangential direction. The number of these pairs of components 30, 32 may be several tens.

The first and second components 30, 32 are metal, preferably blocks made of lead or cast iron or one of their alloys, this type of material making it possible to ensure both radiological protection against gamma radiation, and satisfactory thermal conductivity. The first and second components 30, 32 have a very similar shape, while being positioned in an inverted manner along the longitudinal direction, as will appear clearly hereafter.

As regards each first component 30, its outer surface is supported, and more preferentially is in direct contact, against the inner surface 24*a* of the outer shell 24. This contact is preferentially a surface contact, over the whole surface of the block 30 that is facing the inner surface 24*a*. To do this, its outer surface has in transversal section a convex arc of circle shape of diameter similar or identical to that of the inner surface 24*a*, and of same centre, even if a straight section could be envisaged, without going beyond the scope of the invention.

Moreover, its inner surface is at a distance from the outer surface 22*a* of the inner shell 22, and in contact with the outer surface of the second component 32 that is superimposed radially on it.

This second component 32 has its inner surface supported, and more preferentially is in direct contact, against the outer surface 22*a* of the inner shell 22. This contact is preferentially a surface contact, over the whole surface of the block 32 which is facing the outer surface 22*a*. To do this, its outer surface here has, in transversal section, a concave arc of circle shape of diameter similar or identical to that of the outer surface 22*a*, and of same centre, even if a straight section could also be envisaged.

In this first preferred embodiment, the two components 30, 32 of each pair have an identical circumferential span, and superimpose each other perfectly along the radial direction. In other words, each of the two is uniquely supported radially on the other component of the pair, which also results in a same orientation of the two components of identical circumferential span.

The pairs of components 30, 32 that succeed each other circumferentially may also have identical or different circumferential spans.

As evoked previously, the inner surface of each first component 30 and the outer surface of the second component 32 that is associated with it are in surface contact, at an interface referenced 40 in the figures. This interface is flat or truncated, in other words, in this latter case, it takes the form of an angular portion of a truncated surface.

Figure 3:
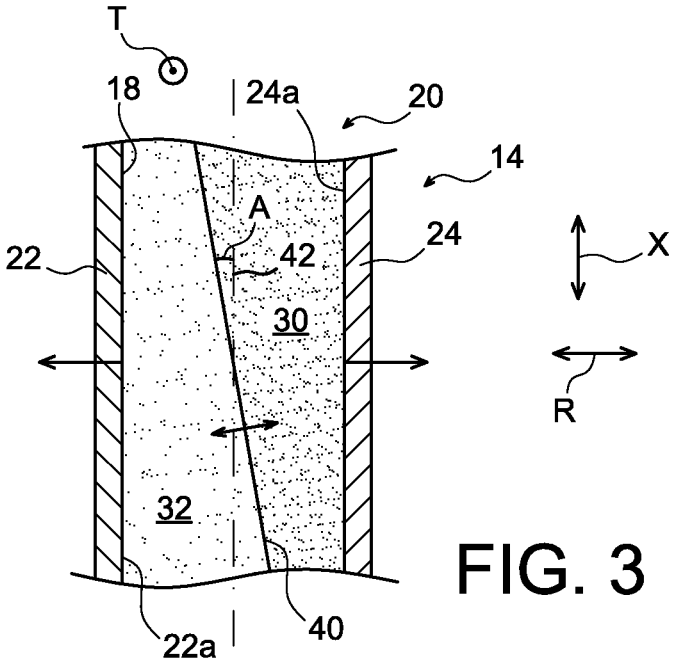
FIG. 3 represents a sectional view taken along the line III-III of FIG. 2.

The interface 40 has, in section passing through any longitudinal plane crossing it and integrating the axis 8, the form of a straight line segment inclined by an angle A in relation to a longitudinal straight line 42 parallel to the direction X. This angle A is preferentially low, for example between 1 and 10°, as shown in FIG. 3. It is noted that in the same section, the interfaces between the shells and their associated component are for their part straight line segments parallel to the direction X. Consequently, one of the components 30, 32 has a section that tapers off along a given direction of the longitudinal direction X, whereas the other component has a section that tapers off in an analogous manner in the opposite direction to said given direction.

Moreover, FIG. 2 illustrates that in section along any plane orthogonal to the longitudinal axis, each interface plane 40 takes the form of a straight line segment oriented substantially circumferentially, and more precisely orthogonally to a radial straight line 41 passing through the centre of the segment, as well as, obviously, through the longitudinal axis 8 (not visible in FIG. 2).

With such a configuration, the heat released by the assemblies is conducted in a continuous manner between the two shells 22, 24, which confers a satisfactory thermal conductivity to the lateral body. As shown schematically by the arrows of FIG. 2, the heat is firstly conducted between the inner shell 22 and the second component 32 of each pair, then between the first and second components 30, 32 in contact, and finally between the first components 30 and the outer shell 24.

One of the main advantages of this solution lies in continuous privileged heat conduction paths being obtained between the two shells, with components 30, 32 of simple shape, each in contact with only one of these two shells.

Here, each of the components 30, 32 is thus maintained uniquely by contacts in the annular space 18, each of them being pinned against one of the shells and against the protection component being superimposed radially on it.

To ensure the manufacture of the canister, and more particularly for the assembly of each pair of radiological protection components, the second component 32 is firstly put in place in the annular space 18, against the outer surface 22*a* of the shell 22. Its tapering part is then near to the opening of the canister, whereas its other end, the thickest, lies for example on the bottom of the canister.

Figure 4:
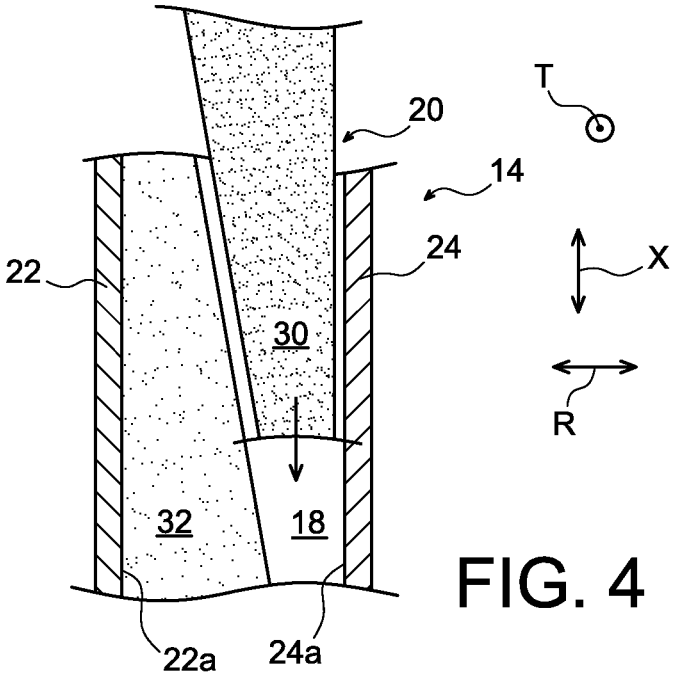
FIG. 4 schematically represents a step of the method for producing the canister shown in the preceding figures.

Then, as shown schematically in FIG. 4, the first component 30 is slid longitudinally between the outer shell 24 and the component 32 already in place, with its tapering end progressively coming closer to the thick end of this component 32. This sliding is carried out up to surface contact being obtained at the interface between the two components 30, 32, and surface contact being obtained between the first component 30 and the inner surface 24*a* of the shell 24.

The continuation of the longitudinal displacement of the first component 30 in relation to the component 32 leads to increasing the intensity of the contacts, and thus to reinforcing the thermal conductivity.

It is noted that an inverted configuration could be envisaged, in which the first component 30 would be put in place before the second, without going beyond the scope of the invention.

In addition, it is indicated that the pairs of components are preferably assembled successively, even if it may be envisaged to place firstly all of the second or all of the first components of all the pairs, over 360°, then next to slide all of the other components into the annular space.

Figure 5:
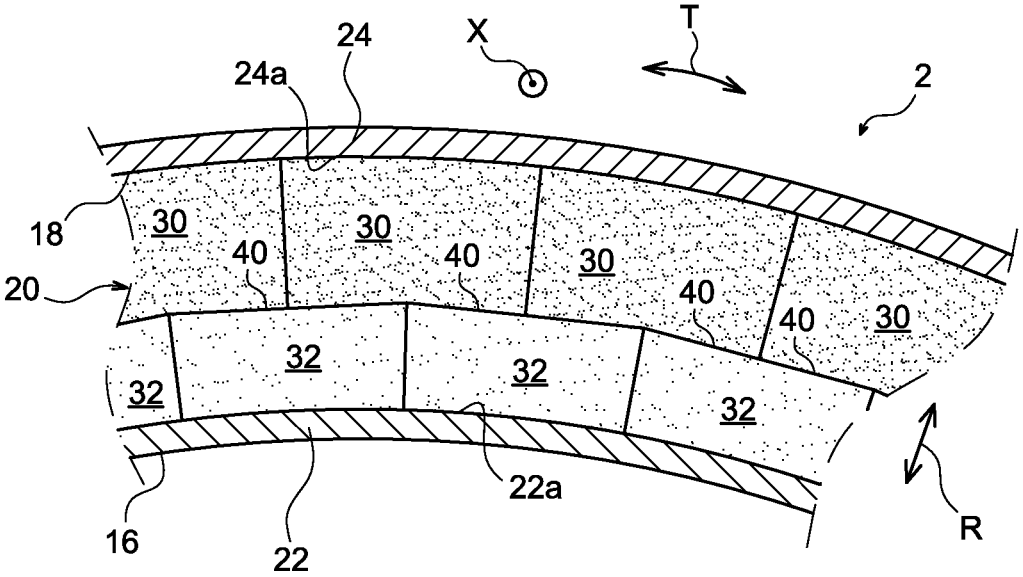
FIGS. 5 and 6 represent similar views to that of FIG. 2, the canister being in the form of other preferred embodiments.

In FIG. 5, the second preferred embodiment represented therein no longer comprises radiological protection components spread out in pairs, but the components 30, 32 are here laid out in a quincunx. Thus, each first component 30 is supported radially against two second components 32 directly adjacent along the circumferential direction, and inversely. In this preferred embodiment, in which the first components remain in circumferential contact with each other, just like the second components, the circumferential span of each of the components 30, 32 is equally well identical or different.

Figure 6:
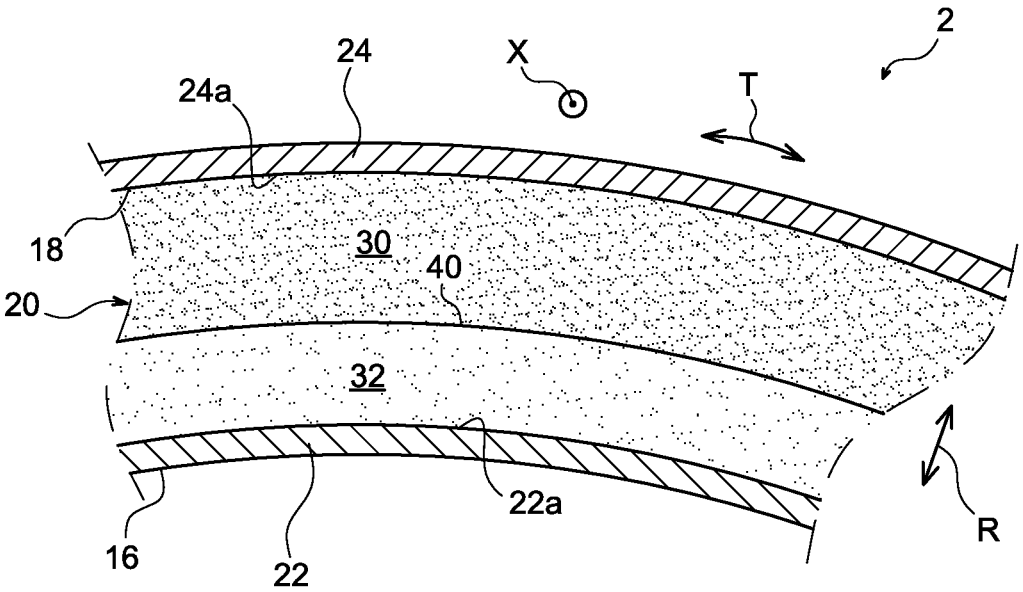

Finally, FIG. 6 shows a third preferred embodiment in which only a single shell shaped first component 30 and a single second component 32, also shell shaped, are provided, the interface 40 being here truncated, centred on the axis 8 (not represented) of the shells.

Obviously, various modifications may be made by those skilled in the art to the invention that has just been described, uniquely by way of non-limiting examples.

The invention claimed is:

1. Canister for transporting and/or storing radioactive materials, said canister comprising:

a lateral body extending around a longitudinal axis of said canister, said lateral body forming a cavity for housing radioactive materials and comprising an inner metal shell and an outer metal shell, the two shells being concentric and forming jointly an annular space inside which is housed a radiological protection device forming a barrier against gamma radiation, wherein said radiological protection device comprises at least one first and one second metal radiological protection components superimposed along a radial direction of the canister, said first component being supported against the inner shell and said second component being supported against the outer shell, wherein said first and second components are in contact with each other along an interface taking, in section along any plane passing through said interface and integrating the longitudinal axis, the form of a straight line segment inclined in relation to this axis, and wherein the inclined straight line segment is inclined at a non-zero angle with respect to the longitudinal axis, wherein the first and second components are wedged between the inner metal shell and the outer metal shell, wherein the first component is in direct surface contact with an outer diameter of the inner metal shell and the second component at the interface, and wherein the second component is in direct surface contact with an inner diameter of the outer metal shell and the first component at the interface, and wherein the position of each of the first and second components between the inner metal shell and the outer metal shell is maintained only by the direct contacts between the inner metal shell, first component, second component and outer shell in the annular space.

2. Canister according to claim 1, wherein that said inclined straight line segment forms with said longitudinal axis an angle (A) between 1 and 10° .

3. Canister according to claim 1, wherein said interface between said first and second components is flat or truncated.

4. Canister according to claim 1, wherein interface is flat and takes, in any section along a plane orthogonal to the longitudinal axis, the form of a straight line segment orthogonal to a radial line passing through its center.

5. Canister according to claim 1, wherein said interface is truncated and coaxial with the inner and outer shells.

6. Canister according to claim 1, wherein the outer surface of the first component supported against the outer shell is of straight section or arc of circle shape of diameter identical to that of the inner surface of the outer shell against which it is supported, and in that the inner surface of the second component supported against the inner shell is of straight section or arc of circle shape of diameter identical to that of the outer surface of the inner shell against which it is supported.

7. Canister according to claim 1, wherein said first and second components have an identical or different circumferential span.

8. Canister according to claim 1, further comprising a plurality of first metal radiological protection components and a plurality of second metal radiological protection components, each first component being supported radially uniquely on one of said plurality of second components, and inversely.

9. Method for producing a canister according to claim 1, wherein firstly one of said first and second components is put in place in the annular space, then the other of said first and second components is inserted longitudinally between its associated shell and the component already put in place.

* * * * *